United States Patent [19]

Burnside

[11] 4,239,225

[45] Dec. 16, 1980

[54] ROTATABLE DISC STOP APPARATUS

[75] Inventor: Walter M. Burnside, Waukegan, Ill.

[73] Assignee: Bally Manufacturing Corporation, Chicago, Ill.

[21] Appl. No.: 970,353

[22] Filed: Dec. 18, 1978

[51] Int. Cl.[3] ..... A63F 5/04

[52] U.S. Cl. ..... 273/143 R; 74/522

[58] Field of Search ..... 273/143 R, 143 D, 138 R, 273/138 A, 142 JD; 74/575, 577 R, 577 S, 577 SF, 577 M, 578, 522; 188/82.7, 82.74, 69; 335/15; 58/109

[56] References Cited

U.S. PATENT DOCUMENTS

| | | | |
|---|---|---|---|
| 2,082,014 | 6/1937 | Lindstrom | 335/15 X |
| 2,477,137 | 7/1949 | Mihalek | 74/577 S X |
| 2,579,241 | 12/1951 | Nicolaus | 273/138 A X |
| 3,045,503 | 7/1962 | Kiessling | 74/522 X |
| 3,075,403 | 1/1963 | Hepner | 74/522 X |
| 4,071,246 | 1/1978 | Hooker | 273/143 R |

FOREIGN PATENT DOCUMENTS

| | | | |
|---|---|---|---|
| 223027 | 7/1959 | Australia | 273/143 R |
| 395639 | 1/1974 | U.S.S.R. | 74/575 |

*Primary Examiner*—Richard C. Pinkham
*Assistant Examiner*—Arnold W. Kramer
*Attorney, Agent, or Firm*—Fitch, Even, Tabin, Flannery & Welsh

[57] ABSTRACT

Apparatus is disclosed for stopping a rotatable circular disc of the type which has a plurality of notches in the circumference thereof, such as may be used in game machines which have rotatable symbol carrying reels. The apparatus includes an improved index arm assembly which has the capability of cushioning the shock that occurs when its associated stop member engages a notch of the disc for stopping the same.

13 Claims, 6 Drawing Figures

ROTATABLE DISC STOP APPARATUS

The present invention generally relates to game devices, and more particularly relates to an apparatus for stopping a rotatable disc that may be associated with a game device.

Game devices of the type which have several rotating symbol carrying reels, typically three or more of such reels, and which are commonly known as slot machines, have been the subject of continued research and development through the years. Moreover, the evolving change in the laws of many jurisdictions within the United States and elsewhere with respect to liberalizing gambling has resulted in more developmental activity in this area. While improvements have been made to such game devices, they continue to exhibit certain operational features that have remained relatively unchanged over the yearsand a certain appeal for many players results due to these operational features. For example, when a player initiates operation of the game device by pulling the handle, the reels will immediately begin rotating and will thereafter be sequentially stopped in a very abrupt manner and this sudden stopping is one of the more appealing aspects of their operation. The mechanism for stopping the reels in such an abrupt manner creates significant stress or shock which causes wear to the parts as would be expected. For this reason, added strength to the stopping components has been designed into the mechanism so that the game devices will have a reasonably long useful life, or at least reasonable periods of operation between requirements for rehabilitative maintenance. Some of the game devices, particularly the larger devices having unusually large reels experience what is known as "follow-through and snap-back" where the reel, when abruptly stopped, rotates a small amount due to inertia and then returns to its stopped position. It is believed that this aspect of the operation is also appealing to many players. However, this aspect is primarily caused by wear of the engaging components and is present in new devices to a much lesser extent.

Accordingly, it is an object of the present invention to provide an improved apparatus for stopping a rotatable disc of the type which has recessed notches in the circumference thereof, which apparatus exhibits the above-described desirable operating features and which has a significantly improved useful life.

Another object of the present invention is to provide an apparatus for stopping a rotatable disc of the aforementioned type, which apparatus has means for absorbing the shock that is produced by the stopping action to thereby minimize wear and extend the useful life of the apparatus.

A more detailed object of the present invention is to provide an apparatus for stopping a rotatable disc of the aforementioned type wherein the apparatus includes an index arm having one end attached to a support and the opposite end carrying a stop member for engaging the notches of the disc for stopping the same wherein the index arm is resiliently extendable during initial engagement to cushion the shock during stopping.

Yet another detailed object of the present invention is to provide an improved means for adjusting the stop member of the index arm relative to the support to thereby enable accurate angular positioning of the stopped disc.

Other objects and advantages will become apparent upon reading the following detailed description, in conjunction with the attached drawings in which.

Figure 1:
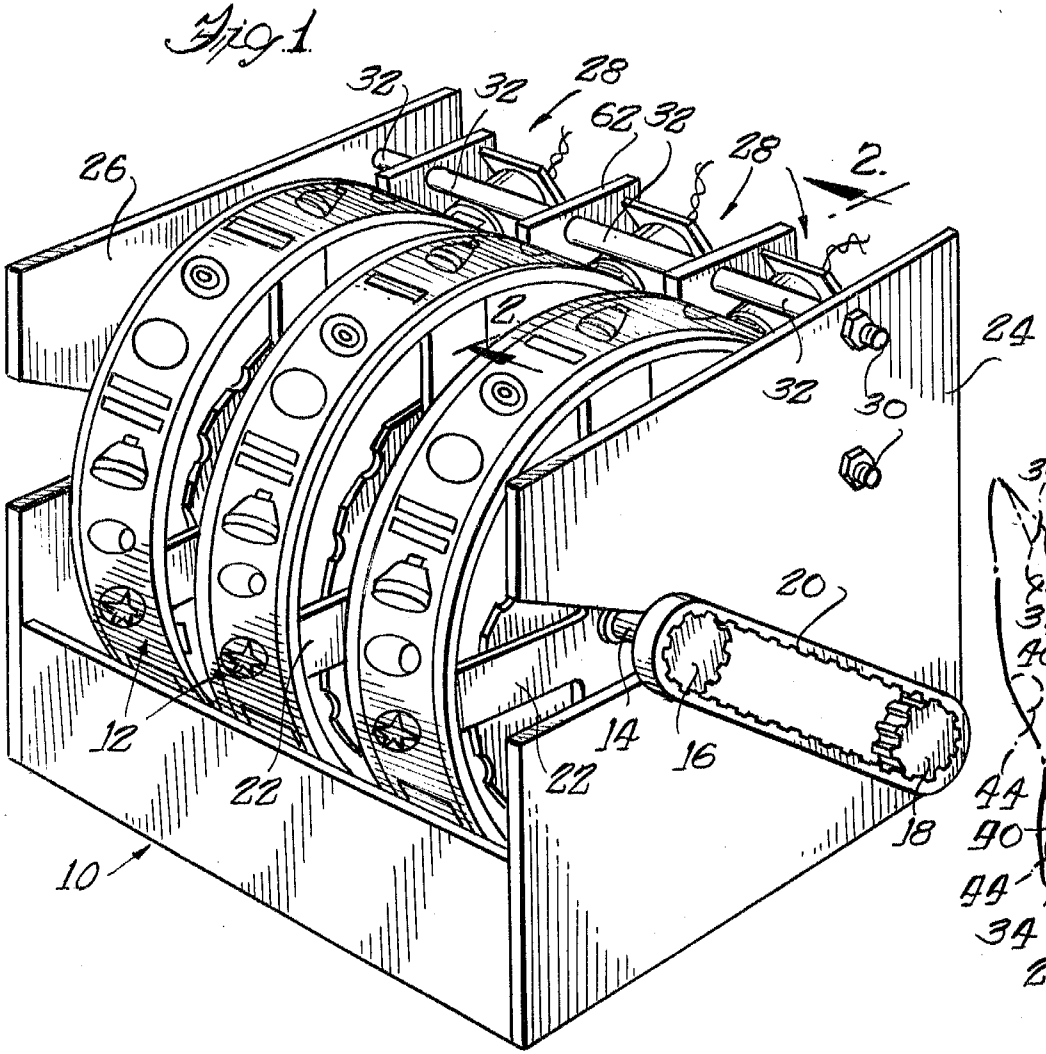
FIG. 1 is a perspective view of a game device in which the stopping apparatus embodying the present invention can be utilized.

Turning now to the drawings and particularly FIG. 1, there is shown a substantial portion of the working internal mechanism, indicated generally at 10, of a game device commonly referred to as a slot machine which includes three reels 12, each of which carries visually observable symbols such as stars, bells or the like along the outer periphery. As is conventionally done, the reels are carried by a common shaft 14 that is driven by a gear 16 that is coupled to a similar gear 18 of a drive motor (not shown) via a belt 20 so that when a player pulls the handle or otherwise initiates operation of the device, the reels are set in motion to be sequentially stopped shortly thereafter. While the shaft 14 is being driven, the reels are capable of slipping relative to the shaft so that toward the end of the play, the shaft 14 may continue to be rotated while the motor is operating even though some of the reels 12 have been stopped. The reels are stopped by a stopping apparatus such as the apparatus embodying the present invention engaging one of a plurality of notches of a separate flat circular disc 22, it being understood that there is a disc and stopping apparatus for each of the reels 12.

In addition to the function of stopping the reels, the discs may also have a number of apertures therein which are used in conjunction with photoelectric means or other light circuit detecting means to determine winning combinations of the reels. The game device is also shown to have a pair of structural side plates 24 and 26 and stopping apparatus embodying the present invention, indicated generally at 28, are shown being mounted between the side plates with a pair of elongated bolts 30 that extend between the side plates 24 and 26 with the appropriate spacing being determined by suitable sleeves 32 that extend between the adjacent stopping apparatus and/or the appropriate side plate.

Figure 2:
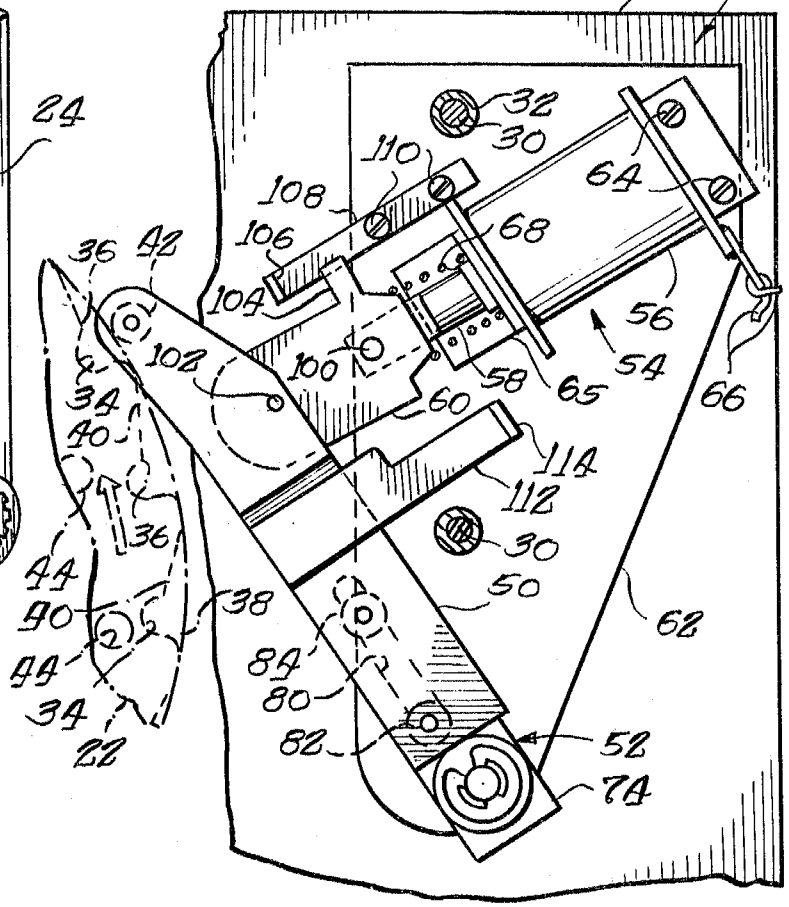
FIG. 2 is a side elevation of stopping apparatus embodying the present invention, particularly showing the apparatus retracted from the disc as would occur when the disc is freely rotating.
Figure 3:
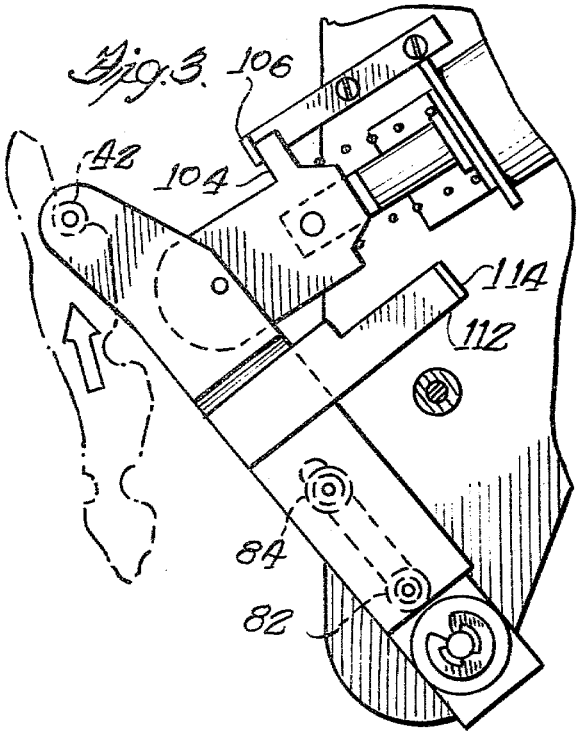
FIG. 3 is a side elevation of the apparatus shown in FIG. 2 and particularly illustrating the stopping apparatus as it initially engages one of the notches of the disc, as well as after the disc has been completely stopped.
Figure 4:
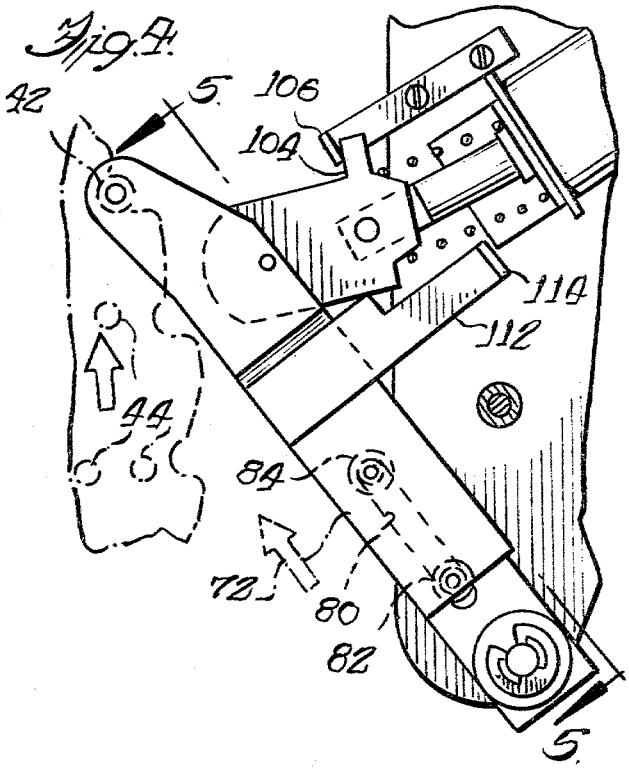
FIG. 4 is a side elevation of the apparatus shown in FIGS. 2 and 3 and particularly illustrating the apparatus in its extended position which would occur after initial engagement with one of the notches.

A typical stopping apparatus 28 embodying the present invention is shown in FIGS. 2–6 with the side elevations of FIGS. 2–4 illustrating the operation in conjunction with one of the discs 22 shown in phantom. The disc 22 has a plurality of notches 34 preferably generally equally spaced along the circumference of the disc with the number of notches also preferably corresponding to the number of individual symbols that are located on the reels 12. With the disc 22 rotating in the counterclockwise direction as shown by the arrows in FIGS. 2–4, the front edge 36 or downstream edge relative to the direction of rotation of the disc terminates at a point that is radially inwardly spaced relative to the outer circumference of the disc shown by the dotted line 38 and the point 36 extends radially outwardly in a generally straight line indicated at 40 to the outer circumference. This enables the stopping apparatus to gradually move radially inwardly as the notch approaches a stop member 42 associated with the apparatus 28 before it engages the notch 34 to stop the disc. The disc is also shown to have a number of apertures 44 which are used by the light decoding circuitry previously mentioned and these apertures may be relatively small, e.g., about ⅛ inch in diameter. The apertures may be provided in six different concentric rows, with each notch position having an appropriate number of apertures in the rows to thereby essentially provide six bits of binary information which can be used to detect the winning combinations.

Turning now to the stopping apparatus 28 embodying the present invention shown in FIG. 2, it comprises an index arm assembly 50 having the stop member 42 at one end portion thereof and an attachment means, indicated generally at 52, at the other end portion, with the index arm assembly being rotatable around the attachment means 52 so that the stop member 42 can be moved into and out of engagement with one of the notches 34 during operation. A pivoting means, indicated generally at 54, is shown to comprise a solenoid which has a coil 56 and a movable plunger 58 with the plunger being interconnected with the index arm assembly 50 by a connecting link 60. The attachment means 52 attaches the index arm assembly to a stationary support 62 and the coil 56 is also mounted on the support 62 with screws 64 and a right angled plate 65. The support 62 has suitable apertures therein through which the bolts 30 are passed. The apertures are of course of smaller diameter than the positioning sleeves 32.

The apparatus shown in FIG. 2 is in the position illustrated when the solenoid coil 56 is energized (by voltage being applied to the electrical conductors 66) so that the plunger 58 is retracted into the coil, i.e., it is moved to the right as shown in FIG. 2. This causes the index arm assembly 50 to be moved to the right so that the stop member 42 is disengaged from the notches which would permit the disc to rotate. When the circuitry which controls the operation of the solenoid removes voltage from the lines 66, the plunger 58 will be moved to the left due to the action of a compression spring 68 that has one end bearing against the mounting angle 65 and its opposite end bearing against the link 60.

When the stop member has initially engaged a notch as is shown in FIG. 3, the disc will be stopped, but the angular momentum of the disc and reel will apply a force in the direction of the arrow 72 shown in FIG. 4 which, due to the construction of the stopping apparatus of the present invention, will result in the index arm assembly 50 being extended, i.e., the stop member 42 will be carried a small distance during the stopping action and this is achieved due to the extendability of the index arm assembly 50 relative to the support 62.

In this regard, it is noted that the specific embodiment has an index arm assembly that is resiliently extendable and that the attachment means 52 is upstream of the stop member 42 relative to the direction of disc rotation. It should be understood that if the attachment means were downstream of the stop member relative to the direction of rotation, a compressible index arm assembly could achieve the desired cushioning effect.

Figure 5:
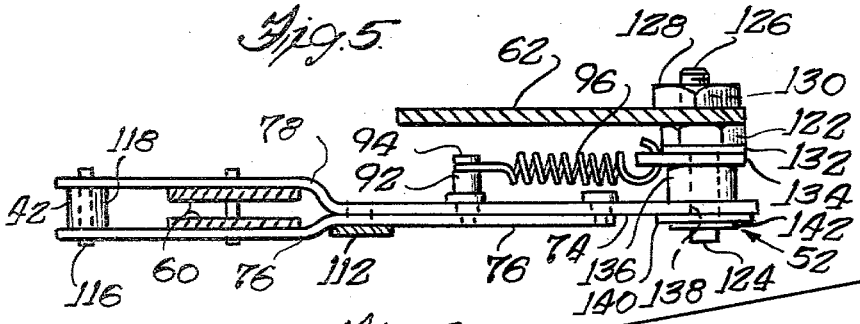
FIG. 5 is a cross sectional view of the apparatus shown in FIGS. 2–4 and is taken generally along the line 5—5 of FIG. 4.

To permit this cushioning effect and referring to FIGS. 2 and 5, the index arm assembly 50 is shown to comprise a first elongated plate member 74 which is attached to the support 62 by the attachment means 52 and a second elongated member 76 having a bifurcated end 78 which carries the stop member 42. The plates 74 and 76 are connected to one another in a manner which permits limited sliding movement generally in the direction of their length. This is accomplished by the member 74 having an elongated slot 80 in which a pair of pins 82 and 84 pass and which are secured in suitable apertures 86 of the member 76. The outer diameter of the portion 88 of each of the pins is slightly smaller than the width of the slot 80 to permit sliding movement thereof and the outer end portion 90 of the pins is enlarged to have a larger width than the width of the slot 80 so that the two members 74 and 76 cannot be separated from one another. The pin 84 also includes a stud portion 92 extending outwardly therefrom having an annular groove for receiving one end of a spring 96 that is tensioned to bias the member 76 in the direction toward the attachment means 52. The unextended position is determined by the pin 82 contacting the end of the slot 80 as shown in FIG. 2. When it is in this unextended position, the pin 84 is spaced a small distance from the opposite end of the slot 80 as shown.

Referring to FIG. 4, when the stop member 42 has been moved into engagement with one of the notches and the angular momentum of the disc moves the index arm assembly 50 to its extended position, the pin 84 is shown to contact the upper end of the slot 80 and thereby limit its movement. When it is in its extended position, the pin 82 is necessarily spaced from the lower end of the slot 80 as shown. After the disc has been stopped, the biasing force of the spring 96 will move the member 76 back to its unextended position as shown in FIGS. 2 and 3. The cushioning effect produced by the apparatus embodying the present invention also results in an advantage in that the disc 22 may be fabricated from less expensive material than has been used in many prior discs. Since the cushioning effect significantly lessens the wear that is occasioned on the notches, mild steel or noncasehardened steel may be used which reduces the initial manufacturing costs. The effective useful life of the disc should typically be at least doubled using stopping apparatus embodying the present invention compared with stopping apparatus which did not employ the teachings of the present invention.

In keeping with the present invention, the connecting link 60 actually comprises a pair of identical components which are attached to the plunger 58 by a pin 100 so as to permit pivoting movement therebetween and, similarly, the components are connected to the bifurcated end 78 by a pin 102. It is preferred that the connecting link 60 be made of a nonmagnetic material so that it does not affect the magnetic characteristics of the solenoid and in this regard, bakelite or some plastic material performs quite satisfactorily. The link may have a transverse extension 104 for engaging a transverse extension 106 of a member 108 that is suitably attached to the support 62 by screws 110 or the like and the purpose of the extensions is to provide a stop to limit the leftward movement of the plunger, like and index arm assembly in the event the reel and associated disc are removed for maintenance. The member 76 may have an elongated member 112 with an angled extension 114 connected to it which maintenance personnel may use to manually disengage the stop member from the notches if desired. The stop member 42 is preferably in the form of a pin 116 having an outer roller 118 so that wear caused by engagement with the grooves is generally evenly distributed.

Figure 6:
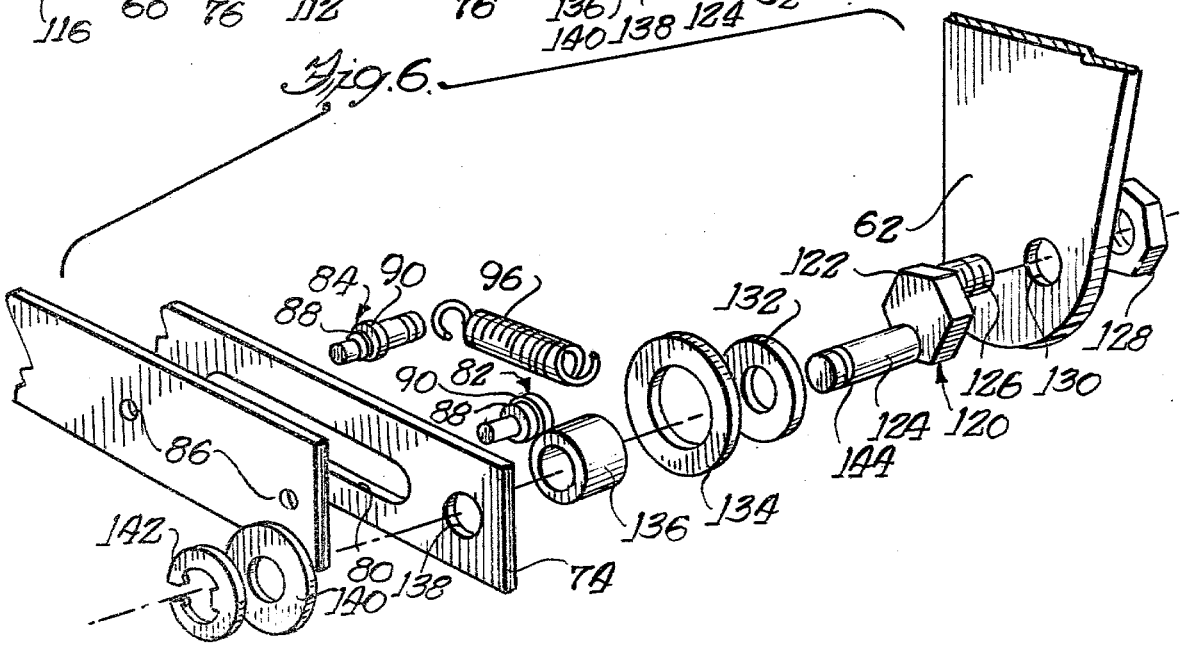
FIG. 6 is an exploded perspective view illustrating the attachment means together with a portion of the index arm means shown in FIGS. 2–5.

In accordance with another aspect of the present invention, the attachment means 52 best shown in the cross-sectional view of FIG. 5 and the exploded perspective view of FIG. 6 is adapted to provide a relatively small adjustment of the index arm assembly 50 relative to the support 62 which effectively enables adjustment of the rotational position of the disc within a relatively small range when it has been stopped, i.e., when the stop member 42 is engaged in one of the notches. As previously mentioned, the disc contains the apertures 44 which are used by suitable circuitry which detects the winning combinations for the game devices and it should be appreciated that the relatively small apertures 44 must be properly aligned so that the light detecting circuits will properly operate. Thus, it should be appreciated that if the disc is stopped in an improperly angularly aligned position, a phototransistor or the like which should detect the presence of light through one of the apertures would not detect the light and this would provide incorrect decoding of the symbol.

Since reasonable manufacturing tolerances may often result in such inaccurate alignment, the attachment means is adapted to enable small adjustment to correct for such misalignment. This is accomplished by an eccentric mechanism which is best shown in FIGS. 5 and 6. The key element of the attachment means is a component, indicated generally at 120, which has a hexagonal head 122 which is adapted to receive a wrench for rotation thereof. The head 122 has a concentrically aligned stud 124 attached to one side thereof as well as an off-centered stud 126 attached to the opposite side. The stud 126 is shorter than the stud 124 and the stud 126 has threads for receiving a suitable nut 128, and as shown in FIG. 5, extends through an opening 130 in the support 62 for attachment to the support. The stud 124 carries a small washer 132, a larger washer 134, a sleeve 136 and the portion of the stud beyond the sleeve 136 is inserted through a suitable aperture 138 in the plate member 74. The stud 124 is attached to the plate member 74 by a washer 140 and an E-ring type of snap connector 142 that sits in an angular groove 144. The index arm assembly 50 is free to pivot around the stud 124 as desired. If the index arm assembly is desired to be moved in a direction parallel to its length, i.e., to the left or right as shown in FIG. 5, it is only necessary to loosen the nut 128 and thereafter rotate the hexagonal head 122 to move the index arm assembly 50 by an amount that is equal to two times the amount of offset of the stud 126 relative to the center of the head 122. In this regard, it is preferred that the offset being in the range of about $\frac{1}{8}$ inch to about $\frac{1}{4}$ inch. This results in a disc having an outer diameter of about $6\frac{1}{2}$ inches being adjusted within the range of about 2° to about 5°. After the index arm assembly has been properly adjusted, it is only necessary to tighten the nut 128 to maintain the proper aligned position. The larger washer 134 is preferably of a size which permits the end of the spring 96 to be inserted into the inside diameter for holding the same.

From the foregoing it should be appreciated that an improved apparatus for stopping a rotating disc that may be used in game devices such as slot machines or the like has been shown and described which offers significant advantages in terms of providing a greatly extended useful life. The capability of cushioning the shock that is produced by an abrupt stopping of the disc greatly reduces the wear that is typically experienced by such game devices. In addition to greatly extending the useful life, less expensive materials may be used compared to prior devices which lessen the initial cost of manufacture.

Although particular embodiments of the present invention have been illustrated and described, various modifications, substitutions and alternatives will be apparent to those skilled in the art, and accordingly, the scope of the invention should be defined by the appended claims and equivalents thereof.

Various features of the invention are set forth in the following claims.

What is claimed is:

1. Apparatus for stopping a rotating reel of the type that is used in an amusement or game device and which has an associated circular disc with a plurality of recessed notches positioned along the circumference thereof, said notches being adapted to receive a stop member for stopping rotation of the disc and reel, said apparatus comprising:

an elongated index arm means having attachment means at a first end portion for pivotally attaching the index arm means to a stationary support and having a stop member at the opposite second end portion thereof for engagement with one of the notches when said index arm means is pivoted toward said disc, said index arm means comprising two members that are slideable relative to one another from a first unextended position to a second extended position and means interconnecting said two members for biasing the same toward said unextended position, one of said members carrying said stop member, the other member having said attachment means associated therewith, said members moving from said first position toward said second position in opposition to the resistance of said biasing means responsive to said stop member engaging one of said notches of the rotating disc to cushion the shock of engagement; and, means attached to said index arm means for pivoting the same so that said stop member is moved into and out of engagement with one of said notches.

2. Apparatus as defined in claim 1 wherein each of said members has elongated flat parallel plate portions, one plate portion of which contains an elongated slot, the other plate portion of which contains at least two pin members positioned in the slot, each of said pins being adapted to engage an end of the slot to limit movement between said extended and unextended positions.

3. Apparatus as defined in claim 2 wherein the member containing said attachment means has said elongated slot, said pins being connected to said member having said stop member, said biasing means comprising a tension spring with the opposite ends thereof being respectively connected to said attachment means and one of said pins.

4. Apparatus as defined in claim 1 wherein said attachment means includes means for adjusting the position of said index arm means relative to said stationary support so as to permit adjustment of the angular position of the disc by a small amount when the stop member is in engagement with one of said notches.